United States Patent [19]

Koenig

[11] 4,105,204

[45] Aug. 8, 1978

[54] TENNIS STROKE PRACTICE DEVICE

[76] Inventor: Wilbur V. Koenig, 9891 Good Luck Rd., Lanham, Md. 20801

[21] Appl. No.: 794,672

[22] Filed: May 6, 1977

[51] Int. Cl.[2] ..... A63B 69/38

[52] U.S. Cl. ..... 273/29 A

[58] Field of Search ..... 273/29 A, 200 R, 206, 273/33, 95 A, 202, 204, 208, 205, 191 A, 191 R

[56] References Cited

U.S. PATENT DOCUMENTS

| | | | |
|---|---|---|---|
| 1,005,948 | 10/1911 | English | 273/191 A |
| 1,595,130 | 8/1926 | Wilcox | 273/204 |
| 2,057,894 | 10/1936 | Harvey | 273/202 |
| 2,219,732 | 10/1940 | Armstrong | 273/205 |
| 3,126,206 | 3/1964 | Sabia | 273/200 R |
| 3,231,271 | 1/1966 | Murphy | 273/29 A |
| 3,246,898 | 4/1966 | Shoaf, Jr. | 273/191 R |
| 3,866,912 | 2/1975 | Scaimetti | 273/29 A |

FOREIGN PATENT DOCUMENTS

| | | | |
|---|---|---|---|
| 8,341 of | 1914 | United Kingdom | 273/191 A |

*Primary Examiner*—Richard C. Pinkham
*Assistant Examiner*—T. Brown
*Attorney, Agent, or Firm*—A. J. Castorina

[57] ABSTRACT

A tennis stroke practice device comprised of a base plate having an upstanding tubular member positioned thereon to receive a Z-shaped tube adjustably therein with the Z-shaped tube being in turn comprised of telescoping members for adjusting the length thereof with one of said telescoping portions having a ball positioned thereon whereby a user can place a stringless tennis racquet thereover and practice his stroke by swinging the racquet throughout the length of the Z-shaped tube.

8 Claims, 3 Drawing Figures

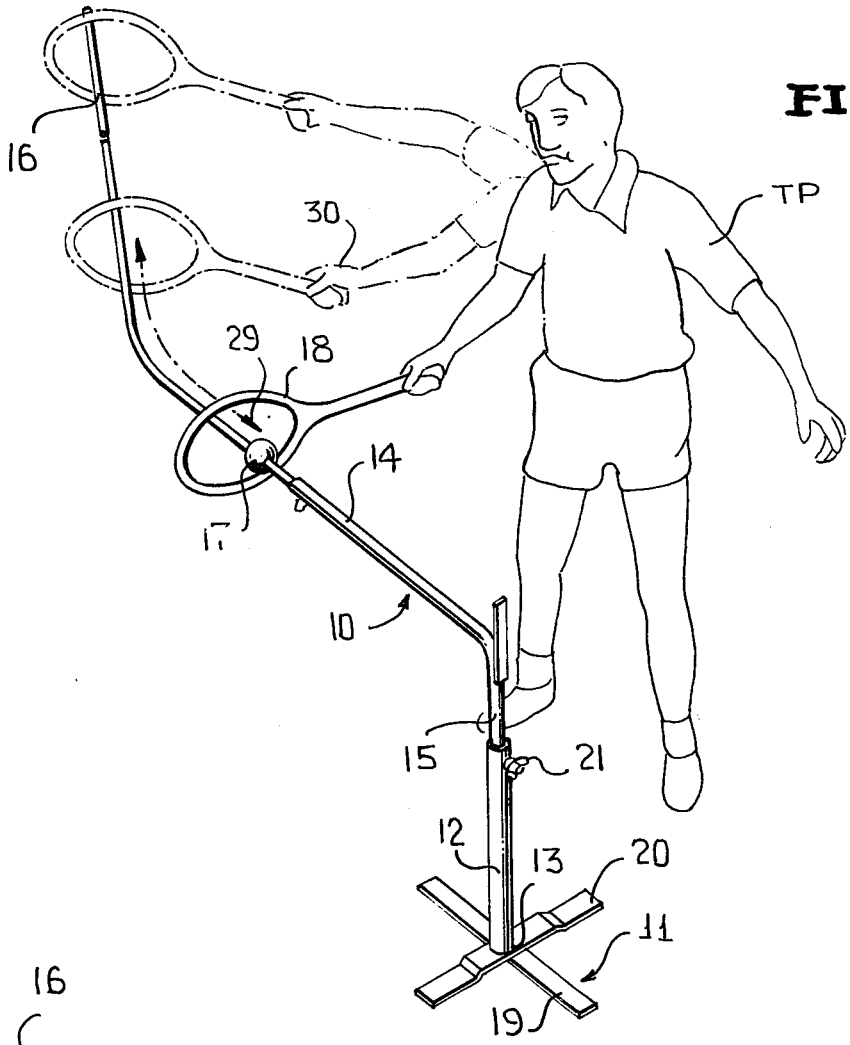
FIG. 1
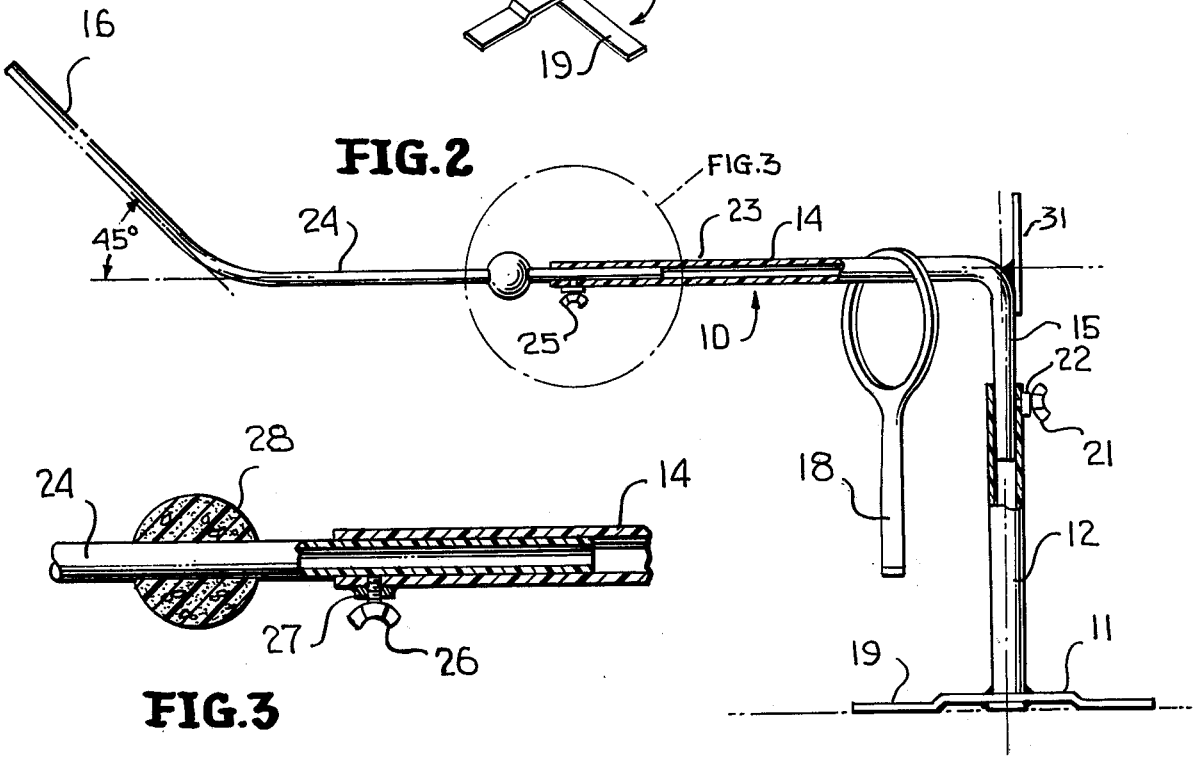
FIG. 2
FIG. 3

TENNIS STROKE PRACTICE DEVICE

BACKGROUND OF THE INVENTION

With the increasing interest in tennis various aids and instructing devices for players have been devised, but none of the same deal with apparatus for improving a player's various tennis strokes. These strokes are generally practiced in play or under a professional's guidance, and therefore, a player does not have the capability of determining if his stroke is proper when he attempts to practice the same in an individual fashion.

SUMMARY OF THE INVENTION

The present invention relates to a tennis stroke practicing device which will positively inform the user if his stroke is proper. To this end, the practice device is so contoured that the placing of a stringless tennis racquet over the contoured surface restrains the same so that it must follow a definite and correct path whereby the stroke will be accurate.

The device comprises a ground engaging support means adjustably receiving a telescoping Z-shaped member therein with a ball positioned on one of the telescoping members to act as a gauge with respect to a stringless tennis racquet placed thereon.

DESCRIPTION OF THE DRAWINGS

FIG. 1 shows a perspective view of a tennis player utilizing the device of the present invention;

FIG. 2 is a sectional view of the device showing the details thereof; and

FIG. 3 is a sectional view showing further details of the device taken along the FIG. 3 line of FIG. 2.

DETAILED DESCRIPTION OF THE PREFERRED EMBODIMENT

With reference to FIG. 1, the tennis stroke practice device of the invention is designated generally by the reference numeral 10. As seen therein, the device is comprised of a base 11, having an upstanding vertical tube 12, secured thereto at 13, by welding or the like. A Z-shaped member 14, has one leg thereof 15, adjustably received in the tube 12. The free end 16, of the member 14, is positioned at a 45° angle with respect to a horizontal line extending through the major portion of the member 14. A ball 17, is positioned on the member 14, and serves to act as a gauge with respect to a stringless racquet 18, moved along the length thereof as clearly shown in FIG. 1.

Referring to FIG. 2, the details of the device are seen to be comprised of simple, minimal and economical parts. The base 11, consists of two cross legs 19, 20, supporting a hollow tube 12, at the intersection of the legs 19, 20, with the upper portion thereof adjustably receiving the leg 15 of the Z-shaped member 14. Adjustment means 21, comprising a wing-type nut associated with a locking nut 22, lock the leg 15 in any vertical desired position to thereby determine the position of the main portion of member 14 with respect to the ground. As is further seen, the Z-shaped member 14 is comprised of two telescoping sections 23, 24, which are adjustably positioned with respect to one another by adjusting means 25, comprised of a wing screw member 26, cooperating with a locking nut 27. The free end 16 of the member 14, is seen to be disposed at approximately 45° with respect to the horizontal position of member 14 which angulation determines the end stroke of the player using the device. A ball 17, is positioned on bar 24, to act as a gauge with respect to the stringless tennis racquet 18 when the same is moved relative thereto, and seen in FIGS. 1, 2 and 3. A stop member 31 is secured to the ball 14 in any suitable fashion to maintain the racquet 18 thereon.

In use, and as seen in FIG. 1, the tennis player TP, has placed the stringless tennis racquet 18, over the bar 14, and has positioned his feet in order that he may practice his backhand. He initially gauges the center of the racquet 18 with respect to the ball 17, as shown by the headed arrow 29, and thereafter, moves the racquet rearwardly and upwardly due to the inclination of section 16 in the fashion as shown in dotted outline 30 in said FIG. 1. As is appreciated, the shape and contour of the Z-shaped bar 14, makes it impossible for the player TP, to develop a bad stroke. It is also obvious that the player's forehand stroke can be practiced by his moving to the other side of the bar 14.

The device can be fabricated from any desired material such as plastic, aluminum tubing or conceivably, rigidified cardboard. As is apparent, the same can be assembled without the use of special tools or retaining clips.

Various modifications are deemed to be within the purview of the present disclosure and, for example, the base 11, can be formed of a different shape such as circular or spokelike, and the adjusting means can be removed in favor of friction fitting contact between the telescoping portion.

What is claimed is:

1. A tennis stroke practice device comprised of a base means, a support member positioned thereon and extending substantially vertically upward and a Z-shaped elongated member having one end secured to the upper end of said support member and its other end being free, said free end being disposed upwardly the remaining portion of said Z-shaped member connecting said free end said secured end and being disposed substantially parallel to a ground surface, and a stringless tennis racquet positioned over said free end and adapted to be grasped by a player whereby a tennis stroke can be practiced by guiding the racquet over the free end and said remaining portion towards the secured end.

2. The tennis stroke practice device of claim 1 wherein the support member is a hollow tube and is provided with adjusting means for adjustably receiving said one end.

3. The tennis stroke practice device of claim 2 wherein the Z-shaped member is comprised of at least two telescoping members and means for adjustably positioning one with respect to the other.

4. The tennis stroke practice device of claim 3 wherein a ball is adjustably positioned on one of said telescoping members.

5. The tennis stroke practice device of claim 4 wherein the same is fabricated from plastic.

6. The tennis stroke practice device of claim 4 wherein the same is fabricated from aluminum.

7. The tennis stroke practice device of claim 4 wherein the same is fabricated from cardboard.

8. The tennis stroke practice device of claim 1 wherein a stop member is provided on said remaining portion adjacent the secured end to maintain the tennis racquet thereon.

* * * * *